US008016004B2

(12) United States Patent
Farooq

(10) Patent No.: US 8,016,004 B2
(45) Date of Patent: Sep. 13, 2011

(54) MORE SILENT AND ROBUST ELECTRIC PENCIL SHARPENER

(76) Inventor: Anwar Farooq, Montclair, CA (US)

( * ) Notice: Subject to any disclaimer, the term of this patent is extended or adjusted under 35 U.S.C. 154(b) by 272 days.

(21) Appl. No.: 12/243,668

(22) Filed: Oct. 1, 2008

(65) Prior Publication Data

US 2010/0078095 A1 Apr. 1, 2010

(51) Int. Cl.
*B43L 23/00* (2006.01)

(52) U.S. Cl. ..... 144/28.6; 30/452

(58) Field of Classification Search ..... 144/28.1–28.72, 144/28.8; 30/451–462; 142/4–57
See application file for complete search history.

(56) References Cited

U.S. PATENT DOCUMENTS

| | | | | | |
|---|---|---|---|---|---|
| 2,189,476 | A | * | 2/1940 | Siggelko | 144/28.7 |
| 2,335,148 | A | | 11/1943 | Hoffmann | |
| 2,470,387 | A | * | 5/1949 | Baggett | 144/28.11 |
| 2,545,779 | A | | 3/1951 | Harrison | |
| 2,664,071 | A | * | 12/1953 | Guhl | 144/28.8 |
| 2,822,781 | A | | 2/1958 | Burton | |
| 2,900,958 | A | | 8/1959 | Johnson | |
| 3,134,365 | A | | 5/1964 | Takeo Hori | |
| 3,777,791 | A | * | 12/1973 | Uchida | 144/28.72 |
| 4,601,316 | A | | 7/1986 | Verdi | |
| 4,630,660 | A | * | 12/1986 | McGuire | 144/363 |
| 4,966,208 | A | * | 10/1990 | Uang | 144/28.72 |
| 5,394,613 | A | | 3/1995 | Ku | |
| 6,065,514 | A | | 5/2000 | New | |
| 6,334,475 | B1 | * | 1/2002 | Schultheiss | 144/28.71 |
| 6,886,614 | B2 | * | 5/2005 | Ricono et al. | 144/28.11 |
| 7,240,703 | B2 | | 7/2007 | Hu | |
| 7,472,728 | B1 | * | 1/2009 | Geffen | 144/28.5 |
| 2008/0060720 | A1 | * | 3/2008 | Hu | 144/28.5 |

* cited by examiner

*Primary Examiner* — David J. Walczak
*Assistant Examiner* — Jennifer Chiang
(74) *Attorney, Agent, or Firm* — Ariel S. Bentolila; Bay Area IP Group, LLC

(57) ABSTRACT

A pencil sharpener for sharpening a pencil includes a central gear including an aperture along an axis of the central gear for receiving an end portion of the pencil. A first gear rotates the central gear and a strap joined to the central gear secures the pencil when the central gear is rotated. A shaft is in communication with the first gear where when the central gear is rotated the shaft is rotated. A cutting blade is in communication with the shaft where when the shaft is rotated the cutting blade cuts the end portion of the pencil at an angle to form a point.

13 Claims, 3 Drawing Sheets

MORE SILENT AND ROBUST ELECTRIC PENCIL SHARPENER

FEDERALLY SPONSORED RESEARCH OR DEVELOPMENT

Not applicable.

REFERENCE TO SEQUENCE LISTING, A TABLE, OR A COMPUTER LISTING APPENDIX

Not applicable.

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office, patent file or records, but otherwise reserves all copyright rights whatsoever.

FIELD OF THE INVENTION

The present invention is generally related to pencil sharpeners, and more particularly to a substantially silent, electric pencil sharpener.

BACKGROUND OF THE INVENTION

A typical electric pencil sharpener comprises an electric motor, a gear train, a cutter assembly, and a receptacle for receiving a pencil or a pencil alignment device. The sharpener further comprises a switch for activating the motor, for example, upon insertion of a pencil. When the pencil is positioned in the receptacle, the motor transfers its power to the cutter assembly through the gear train. The pencil is sharpened by a blade of the cutter assembly. Numerous innovations for pencil sharpeners have been provided in the prior art that will be described.

Early designs of a conventional pencil sharpener typically comprise a spring-driven pencil sharpener comprising a top cap having a top opening to receive a pencil and two corresponding slots to receive a fastening device that includes two hollow frames. The pencil sharpener comprises a housing that is constructed with a pair of coupling castings, each of which is accompanied by a lateral cover for disposing a pencil blade set and a spring-driven automatic device. The outline of the housing is preferably designed to cooperate with that of the cap to form an egg-like shape that is comfortable to the hand and is attractive. However, the pencil to be sharpened in this typical sharpener is manually fed into the housing, which is inconvenient compared to an automatic pencil sharpener. In addition, the holding force for the pencil is provided by the user and is unstable, so the pencil sharpener is easily jammed and very noisy.

Another conventional pencil sharpener comprises a sharpening sub-assembly for sharpening pencils and first and second external shells having internal ribs defining surfaces for supporting the sharpening sub-assembly. The sharpening sub-assembly comprises an electric motor, a gear assembly, and a cutter assembly including a cutter gear module having an annular ring gear acting as a carrier support. The subassembly houses a pencil insertion switch and a receptacle presence switch. However, the holding force for the pencil is still provided by the user and is still unstable. The pencil sharpener is easily jammed and very noisy.

Another known automatic pencil sharpener comprises a motor, a transmission device, a cutter assembly, a feeding device, a feeding reverse mechanism, and a manual reverse mechanism. The feeding device has a pair of feeding rollers for feeding the pencil. The manual reverse mechanism for manually retreating the pencil has a pushing rod and a key switch. The pencil is fed by the feeding device and delivered to the cutter assembly. The cutter assembly processes the pencil. After the pencil is shaved, the feeding reverse mechanism drives the motor to rotate in a reverse direction so as to retreat the pencil from the sharpener. When the pencil is too short to shave and stops in the sharpener, the pencil is retreated from the sharpener by the manual reverse mechanism. This apparatus is very noisy also.

It is apparent that numerous innovations for pencil sharpeners have been provided in the prior art. Furthermore, even though these innovations may be suitable for the specific individual purposes to which they are addressed, the pencil is still manually fed with a holding force that is difficult to control such that jamming frequently occurs. Furthermore, the above prior art pencil sharpeners have not addressed the noise issue.

The products that are available in the market today do a fairly good job of sharpening pencils; however, they are annoyingly noisy. Many competitive exams and schools ban the use of electric pencil sharpeners during testing due to noise. The noise comes from grinding the sharpener's metal blade with the pencil's wood body. The older the electric pencil sharpener gets, the louder and less effective it becomes, resulting in pencils that have to be reinserted a number of times to make the lead pointed. Possibly the most annoying side effect is when the electric pencil sharpener keeps sharpening the pencil such that lead is exposed on only half of the side of the pencil and the other side of the pointed lead remains covered with material. The operator must continue to reinsert the pencil into the pencil sharpener in the hope that next time the lead may be fully exposed. This causes the pencil to become smaller and smaller each time.

In view of the foregoing, there is a need for improved techniques for providing an electric pencil sharpener that is quiet and effectively sharpens pencils without jamming.

BRIEF DESCRIPTION OF THE DRAWINGS

The present invention is illustrated by way of example, and not by way of limitation, in the figures of the accompanying drawings and in which like reference numerals refer to similar elements and in which:

FIG. 1 is a perspective view, FIG. 2 is a side view, FIG. 3 is a perspective end view, and FIG. 4 is an end view;

FIG. 6 and 7A are a perspective view, and FIG. 7 is a side view.

Figure 1:
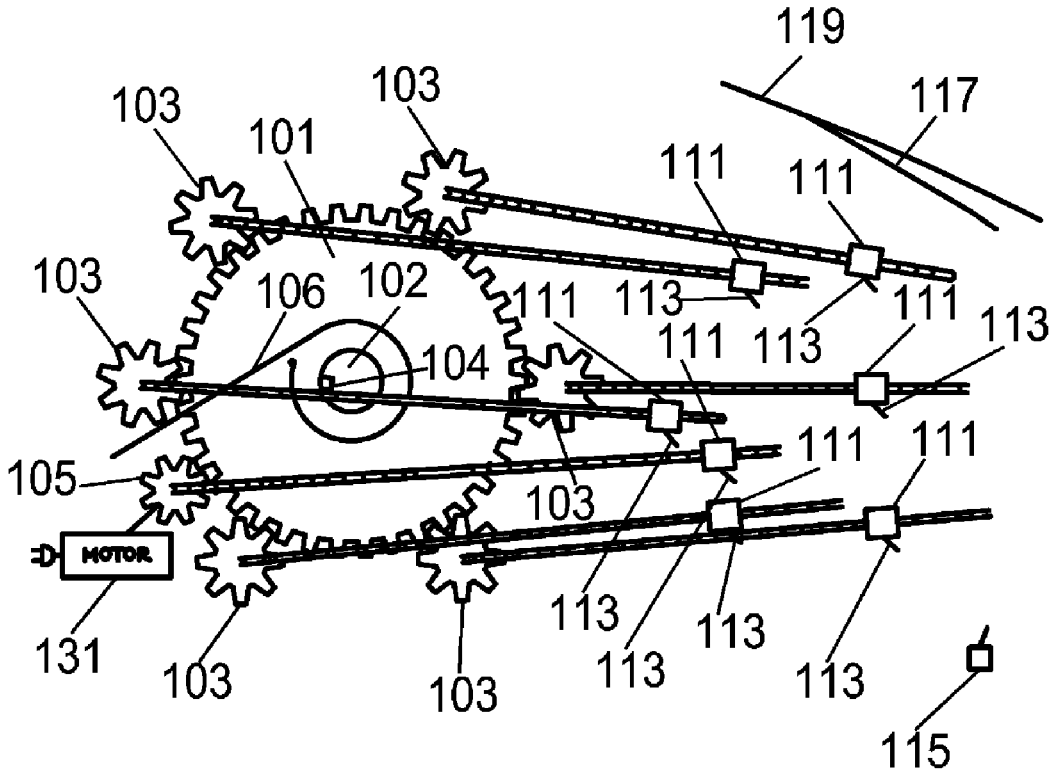
FIGS. 1 through 4 illustrate the interior components of an exemplary pencil sharpener, in accordance with an embodiment of the present invention.

Unless otherwise indicated illustrations in the figures are not necessarily drawn to scale.

SUMMARY OF THE INVENTION

To achieve the forgoing and other objects and in accordance with the purpose of the invention, a more silent and robust electric pencil sharpener is presented.

In one embodiment, a pencil sharpener for sharpening a pencil is presented. The pencil sharpener includes a central gear including an aperture along an axis of the central gear for receiving an end portion of the pencil. A first gear rotates the central gear and a strap joined to the central gear secures the pencil when the central gear is rotated. A shaft is in communication with the first gear where when the central gear is rotated the shaft is rotated. A cutting blade is in communication with the shaft where when the shaft is rotated the cutting blade cuts the end portion of the pencil at an angle to form a point. Other embodiments further include a motor for rotating the first gear in a first direction where the pencil is secured and the cutting blade cuts the pencil and a start switch for detecting the pencil in the aperture and activating the motor to rotate in the first direction. In another embodiment the shaft is threaded and the cutting blade travels along the shaft in a direction along the pencil and towards an end of the end portion of the pencil when the first gear is rotated in the first direction. Another embodiment further includes a limit switch for activating the motor to rotate the first gear in a second direction to release the pencil from the strap. Yet another embodiment further includes a plurality of cutting blades and a plurality of shafts in communication with the first gear where when the first gear is rotated in the first direction the plurality of shafts are rotated and the plurality of cutting blades travel along the plurality of shafts in a direction along the pencil and towards the end of the end portion of the pencil and the plurality of cutting blades cut the end portion of the pencil at the angle to form the point. In still another embodiment each of the plurality of cutting blades travels along separate ones of the plurality of shafts and the plurality of shafts are arranged at angles to form the point. Another embodiment further includes a housing including internal ribs in cooperation with the plurality of cutting blades to substantially prevent the plurality of cutting blades from rotating while traveling along the plurality of shafts. Yet another embodiment further includes a round assembly including a collapsible aperture and the plurality of cutting blades are positioned about a periphery of the collapsible aperture. Still another embodiment further includes a housing including at least one internal rib in cooperation with the round assembly to change a diameter of the collapsible aperture when the first gear is rotated. In yet another embodiment the round assembly further includes a gear assembly in cooperation with the round assembly to change a diameter of the collapsible aperture when the first gear is rotated. Another embodiment further includes a plurality of drums in communication with the first gear for rotating the pencil while the cutting blade rotates in a direction towards an end of the end portion of the pencil when the first gear rotates in the first direction.

In another embodiment a pencil sharpener for sharpening a pencil is presented. The pencil sharpener includes means for housing the pencil sharpener, means for receiving an end portion of the pencil, means for rotating a central gear, means for securing the pencil when the central gear is rotated and means for cutting an end portion of the pencil at an angle to form a point. Other embodiments further include means for detecting the pencil in the housing and means for detecting a limit of the cutting means.

In another embodiment a pencil sharpener for sharpening a pencil is presented. The pencil sharpener includes a housing for housing the pencil sharpener. A central gear includes an aperture along an axis of the central gear for receiving an end portion of the pencil. A first gear rotates the central gear and a motor rotates the first gear in a first direction. A start switch detects the pencil in the aperture and activates the motor to rotate in the first direction. A strap joined to the central gear for securing the pencil when the first gear is rotated in the first direction. A plurality of threaded shafts each joined to a shaft gear are in communication with the central gear where when the first gear is rotated the threaded shafts are rotated. A plurality of blade members each includes a cutting blade. Each of the blade members are in communication with a one of the threaded shafts where when the threaded shafts are rotated the plurality of blade members travel along the plurality of shafts in a direction along the pencil and towards an end of the end portion of the pencil and the plurality of cutting blades cut the end portion of the pencil at the angle to form a point. Another embodiment further includes a limit switch for activating the motor to rotate the first gear in a second direction to release the pencil from the strap. In another embodiment the housing further includes internal ribs in cooperation with the plurality of blade members to substantially prevent the plurality of blade members from rotating while traveling along the plurality of shafts. In yet another embodiment the plurality of threaded shafts are arranged such that axis of the plurality of threaded shafts intersect a point along an axis of the aperture of the central gear. In still another embodiment a number of the plurality of blade members equals six.

Other features, advantages, and object of the present invention will become more apparent and be more readily understood from the following detailed description, which should be read in conjunction with the accompanying drawings.

DETAILED DESCRIPTION OF THE PREFERRED EMBODIMENTS

The present invention is best understood by reference to the detailed figures and description set forth herein.

Embodiments of the invention are discussed below with reference to the Figures. However, those skilled in the art will readily appreciate that the detailed description given herein with respect to these figures is for explanatory purposes as the invention extends beyond these limited embodiments. For example, it should be appreciated that those skilled in the art will, in light of the teachings of the present invention, recognize a multiplicity of alternate and suitable approaches, depending upon the needs of the particular application, to implement the functionality of any given detail described herein, beyond the particular implementation choices in the following embodiments described and shown. That is, there are numerous modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The present invention will now be described in detail with reference to embodiments thereof as illustrated in the accompanying drawings.

A preferred embodiment of the present invention provides a pencil sharpener that should generally eliminate the problems with the prior art previously described. The preferred embodiment is approximately the same size as a regular electric pencil sharpener; however, due to its design the preferred embodiment enables a pencil to be sharpened in less than five seconds with near perfect results every time in just one cycle. The preferred embodiment does not grind the body of the pencil with a rotating metal blade. In fact in the preferred embodiment, neither the pencil nor the blade rotates to sharpen a pencil. Using preferred embodiments, the process of sharpening a pencil is substantially silent other then the slight hum of the motor during operation. Preferred embodiments generally eliminate the half-exposed lead problem described above. The retail price of preferred embodiments should be approximately the same as conventional electric pencil sharpeners. Jamming in a pencil sharpener occurs when the pencil is forced into the sharpener and the motor attached to the cutting assembly fails to handle the extra load and temporarily locks up. In my design, each blade is designed to shave off only a small portion of the material and forcing a pencil will have no effect. To accomplish a jam proof sharpening, a thin flat metal strip loop 106 is installed such that when the motor 131 is energized it rotates gear 101, the metal strip loop 106 tightens around the pencil 121 and holds it in place thus preventing its movement for the duration of the sharpening process. Once the process of pencil sharpening is completed and the reverse switch 115 reverses the motor 131, the metal strip 106 automatically loosens and releases the pencil 121, thus avoiding jamming the pencil sharpener. The need to hold the pencil is so that the pencil does not move during sharpening. Also that people may not impatiently try to quicken the process by manually rotating the pencil while being sharpened and/or try to pull out the pencil before the cycle is complete, which can damage the blades on the sharpening assembly and or could jam the pencil sharpener.

In a preferred embodiment, a pencil sharpener comprises a central gear with an opening for a pencil. The central gear is surrounded by six smaller gears in a circular fashion, or other suitable numbers of gears, each of which drives a shaft which is angled. The angled shafts converge at the opposite end of the pencil sharpener to aid in guiding the pencil. Each shaft includes a blade mounted on a threaded blade member such that when the central gear rotates, the six blades travel down the shafts, removing material from the pencil to form a hexagonal point. Once the blades reach the ends of the shafts, the operation is reversed and the blades travel away from the point back to their original or resting positions near the central gear.

Figure 2:
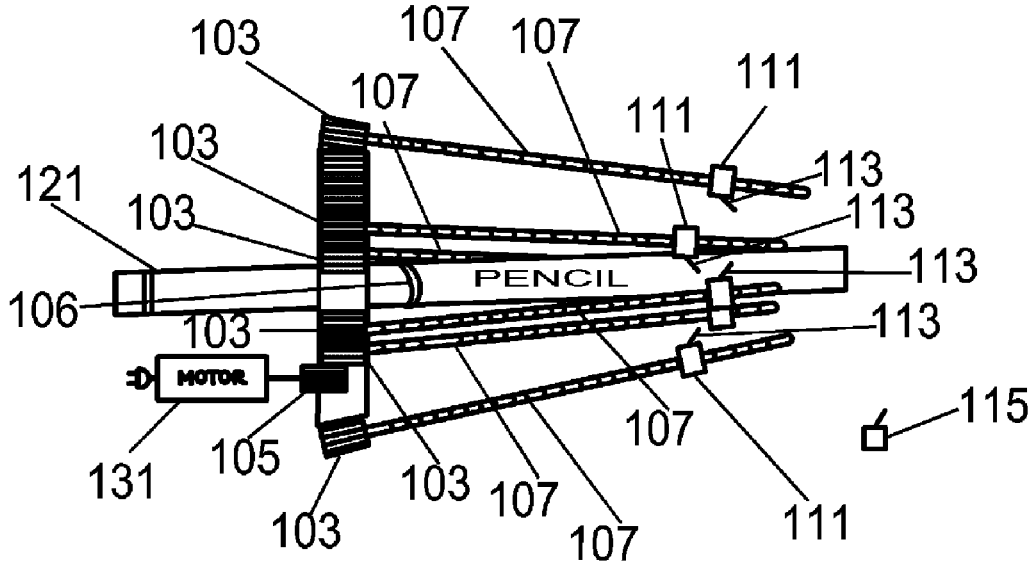
Figure 3:
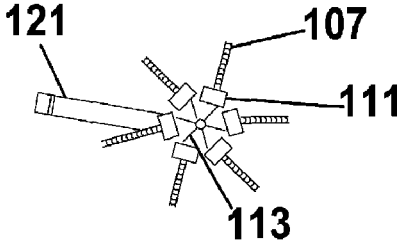
Figure 4:
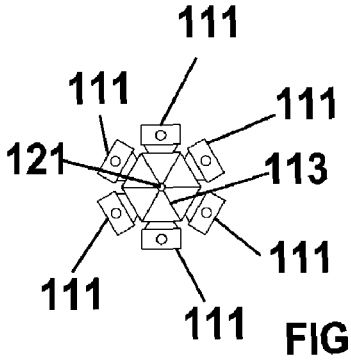

FIGS. 1 through 4 illustrate the interior components of an exemplary pencil sharpener 100, in accordance with an embodiment of the present invention. FIG. 1 is a perspective view, FIG. 2 is a side view, FIG. 3 is a perspective end view, and FIG. 4 is an end view. In the present embodiment, pencil sharpener 100 comprises an electric motor 131 that is energized by switch 104, and is connected to a drive gear 105, which is rotated by motor 131. Drive gear 105 is connected to and rotates a central gear 101. Central gear 101 comprises a central aperture 102 to enable a pencil 121 to be inserted into pencil sharpener 100. Central gear 101 is attached to a housing 119 of pencil sharpener 100 by a round lip around central aperture 102. Around the periphery of central gear 101 are secondary gears 103, which are connected to central gear 101 to rotate with central gear 101. Each secondary gear 103 is connected to an externally threaded shaft 107, which is inwardly inclined towards the center of central gear 101 so that threaded shafts 107 converge at the end of pencil sharpener 100 opposite central gear 101. Threaded shafts 107 comprise external threads to cooperate with the internal threads of blade members 111 each of which has a central aperture with internal threads formed on the interior surface of the central aperture such that when threaded shafts 107 rotate, blade members 111 move the length of threaded shafts 107 without rotation. Each blade member 111 comprises a cutting blade 113 positioned inward to sharpen pencil 121 as it is inserted into pencil sharpener 100. Each blade member 111 is positioned by a rib 117 which is attached to the interior of housing 119 of pencil sharpener 100. Ribs 117 enable blade members 111 to travel along threaded shafts 107 while maintaining cutting blades 113 at inward positions to sharpen the pencil. Pencil sharpener 100 also comprises a limit switch 115 that, when activated by a blade member 111, reverses the direction of the rotation of threaded shafts 107 so that blade members 111 travel back up threaded shafts 107. The present embodiment comprises one limit switch 115 at the end of one threaded shaft 107; however, alternate embodiments may comprise multiple limit switches, for example, without limitation, one limit switch at the end of each threaded shaft.

Referring to FIG. 2, in typical use of the present embodiment, pencil sharpener 100 sharpens pencil 121 mimicking the sharpening of a pencil by a hand using a small pocketknife. The switch 104 energizes the electric motor 131 that rotates gear 105 that in turn rotates the central gear 101 that rotates six secondary gears 103 and the metal strip 106 that locks the pencil 121 tightly in place. Each secondary gear 103 then rotates attached threaded shafts 107. When threaded shafts 107 rotate, blade members 111 with attached sharp blades 113 move the length of threaded shafts 107 without rotation of blade members 111 by being guided by ribs 117 on the inside of housing 119 of pencil sharpener 100. In alternate embodiments, various other means may be used to generally prevent the blade members from rotating, for example, without limitation, slots in the housing in which the blade members slide. In the present embodiment, the shaft and blade assemblies are substantially identical, resulting in six moving blades 113 on six threaded shafts 107. All six threaded shafts 107 converge at the end of pencil sharpener 100 opposite central gear 101; however, threaded shafts 107 do not converge to a point, as blades 113 extend from threaded shafts 107 and converge towards a point. Since many pencils are hexagonal in shape, pencil sharpener 100 comprises six blades 113 in the present embodiment for aesthetic reasons and for each blade to shave off a small amount of material. However, pencil sharpeners in alternate embodiments may comprise more or fewer shafts, blades and secondary gears.

In the present embodiment, the insertion of pencil 121 into pencil sharpener 100 activates a start switch 104 that energizes motor 131. As motor 131 turns, motor 131 turns drive gear 105 to rotate central gear 101. The rotation of central gear 101 rotates the six secondary gears 103 as well as metal strip 106. Since threaded shafts 107 are attached to secondary gears 103, all six threaded shafts 107 rotate simultaneously. Blade members 111 travel on threaded shafts 107 and comprise sharp blades 113 mounted on the external surfaces of blade members 111, and ribs 117 on the interior of housing 119 cooperate with blade members 111 so that blade members 111 travel along threaded shafts and generally prevent blades 113 from rotating, thus maintaining blades 113 in positions opposed to the pencil. The threading on threaded shafts 107 is such that blade members 111 are able to move the length of threaded shafts 107 rapidly. However, in alternate embodiments the threading on the threaded shafts may be designed so that the blade members move more slowly down the shafts. In the present embodiment as pencil 121 is inserted into central aperture 102 of central gear 101, all six blades 113 rapidly move towards pencil 121 from six directions and shave or slice the exterior of pencil 121 along with the internal lead in such a way as to leave the lead finely pointed. At the bottom of threaded shafts 107, blade members 111 trigger limit switch 115 that reverses motor 131 and causes blades 113 of blade members 111 to reverse the direction of travel and to travel up threaded shafts 107 to return to the default starting positions near secondary gears 103 where blade members 111 wait to be reactivated. Some embodiments may comprise one or more limit switches near one or more of the secondary gears to stop the motor once the blade members reach the default positions. In the present embodiment, blades 113 are calibrated and fixed at the correct angle to cause the pencil to sharpen in one cycle. Because pencil 121 does not move and is not grinded, pencil sharpener 100 is virtually noiseless.

Referring to FIG. 3, pencil 121 is shown being sharpened by blade members 111 and cutting blades 113. Blade members 111 are shown traveling along threaded shafts 107. Referring to FIG. 4, an end view of pencil sharpener 100 is shown with pencil 121 in contact with blade members 111 and blades 113.

Figure 5:
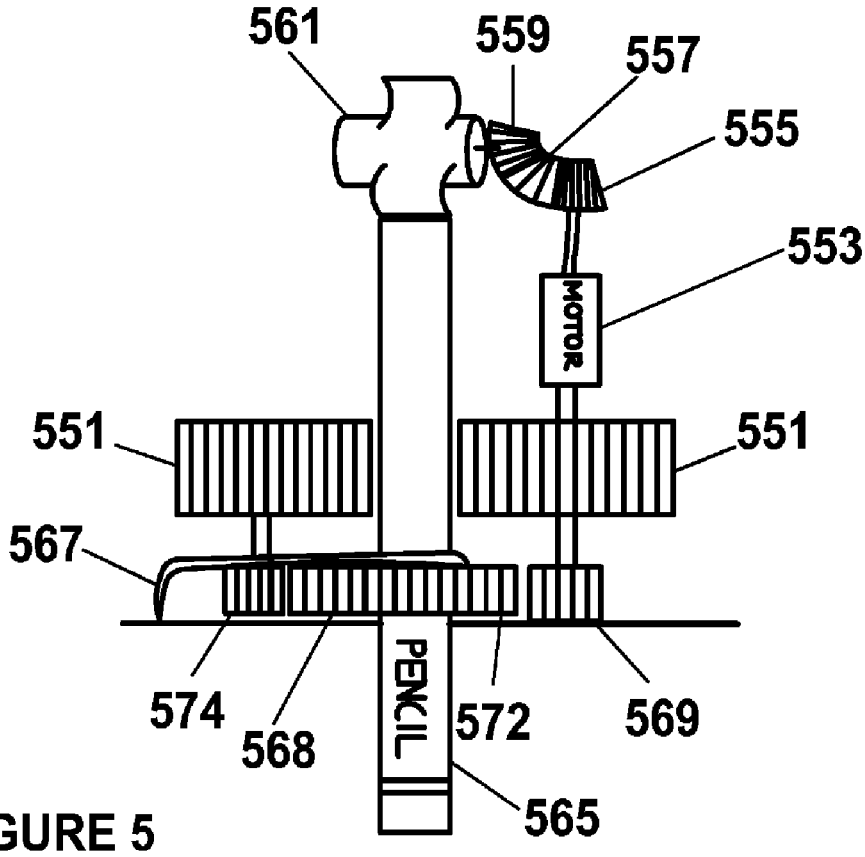
FIG. 5 illustrates a side view of the internal components of an exemplary pencil sharpener with a rotating cutting mechanism, in accordance with an embodiment of the present invention.
Figure 5A:
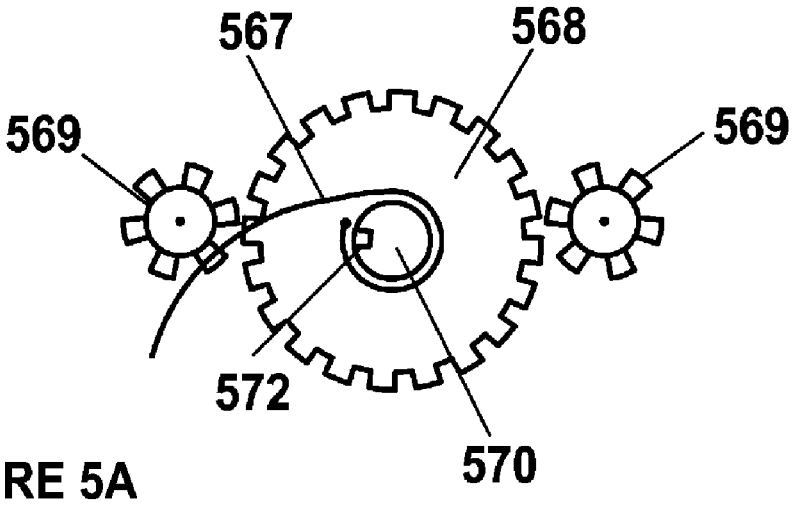

FIG. 5 illustrates a side view of the internal components of an exemplary pencil sharpener 500 with a rotating cutting mechanism 561, in accordance with an embodiment of the present invention. In the present embodiment, pencil sharpener 500 comprises a motor 553 that turns a first drum 551 that is attached to another gear 569. The gear 569 rotates a central gear 568 which in turn rotates another gear 574. Gear 574 is connected to a second drum 551. A metal strip loop 567 is used to firmly hold the pencil in place while being sharpened. When a pencil is inserted through the central gear opening 570, it also passes through the metal strip loop 567 and at the same time activates switch 572 that energizes the motor. As the motor 553 is energized, it tightens the metal strip loop 567 around the pencil 565 thus preventing its movement and causes the blade assembly 561 to rotate as well. This step shave the material off the pencil 565 while simultaneously drums 551 rotate the pencil 565 thus providing the unshaved surface of the pencil 565 for shaving by the blade assembly 561. In addition, motor 553 turns a first gear 555, which in turn rotates a second gear 557, which in turn rotates a third gear 559, which rotates cutting mechanism 561 to sharpen the pencil 565 as pencil 565 is being turned by rotating drums 551.

In the present embodiment of the present invention, rotating cutting mechanism 561 comprises two or more blades. However, alternate embodiments may be configured so that the cutting mechanism has only one blade. In the present embodiment, pencil 565 rotates as well as cutting mechanism 561. In typical use of the present embodiment, when pencil 565 is inserted into opening 570 of the pencil sharpener 500, it goes through metal strip loop 567 and activates the start switch, 572 that energizes motor 553 and causes cutting mechanism 561 to rotate by the rotation transferred to cutting mechanism 561 through gears 555, 557 and 559. Alternate embodiments may comprise alternate means for causing the cutting mechanism to rotate such as, but not limited to, a drive belt connecting the motor to the cutting mechanism, or directly drive the cutting mechanism with another small motor The blades on cutting mechanism 561 shave material from pencil 565. Then pencil 565 is rotated by rotating drums 551 to expose the next unshaved surface of pencil 565 to cutting mechanism 561. At this time, another blade on cutting mechanism 561 rotates around to pencil 565 and slices the next portion of exposed material from pencil 565. Since pencil 565 and the blades of cutting mechanism 561 rotate in sync and at a fast rate, within seconds all surfaces of pencil 565 are shaved in such a way that pencil 565 is left with a pointed lead. In alternate embodiments, the pencil sharpener may comprise multiple rotating cutting mechanisms, for example, without limitation, two rotating cutting mechanisms on opposite sides of the pencil, so that the pencil may be sharpened in less time. These embodiments may require more gears or other rotation means in order to rotate the additional cutting mechanisms.

Figure 6:
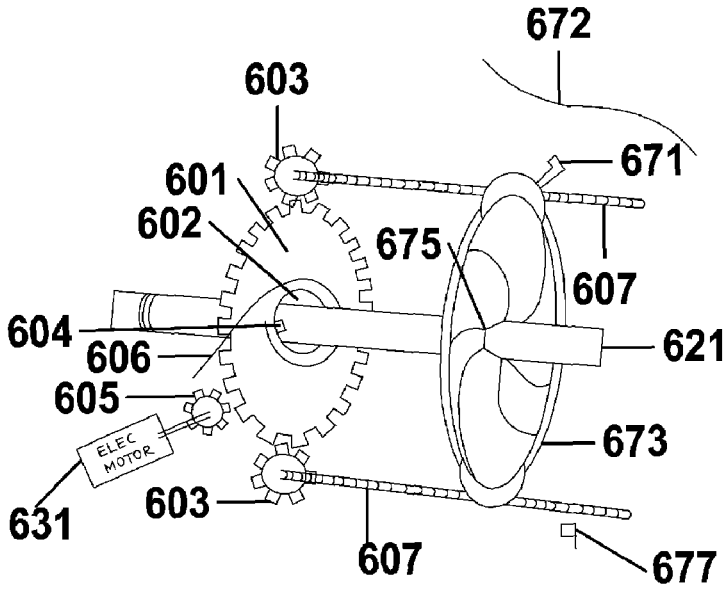
FIGS. 6 and 7 illustrate the internal components of an exemplary pencil sharpener with a collapsible aperture, in accordance with an embodiment of the present invention.
Figure 7:
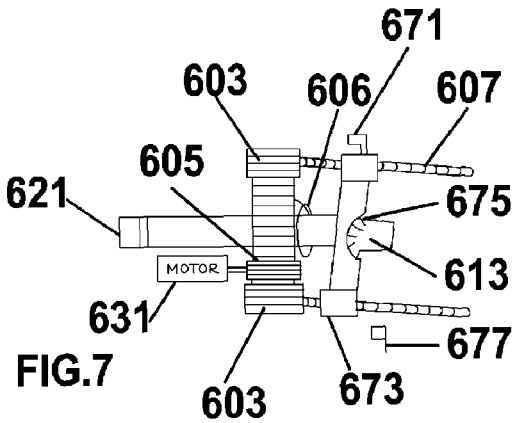
Figure 7A:
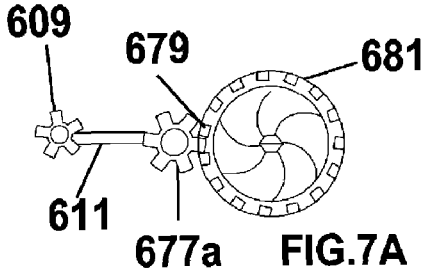

FIGS. 6, 7 and 7A illustrate the internal components of an exemplary pencil sharpener 600 with a collapsible aperture 675, in accordance with an embodiment of the present invention. FIG. 6 is a perspective view, and FIG. 7 is a side view. In the present embodiment, pencil sharpener 600 comprises a central gear 601 comprising a central aperture 602 to cooperate with a pencil 621 to be sharpened. Central gear 601 is rotated by a drive gear 605, which is connected to a motor 631. Central gear 601 is connected to a first secondary gear 603 and a second secondary gear 603, and central gear 601 rotates secondary gears 603. Alternate embodiments may comprise more or fewer secondary gears. In the present embodiment, secondary gears 603 rotate externally threaded shafts 607, which comprise external threads to cooperate with internal threads of a round assembly 673. Round assembly 673 comprises a collapsible aperture 675 that has cutting blades 613 around the periphery of collapsible aperture 675. Round assembly 673 comprises a lever 671 that, when depressed, reduces the diameter of collapsible aperture 675 causing cutting blades 613 to progressively shave off material on the pencil, resulting in the sharpening of the pencil 621. Lever 671 is increasingly depressed by a ridge on a housing 672) of pencil sharpener 600 as round assembly 673 travels away from central gear 601 and secondary gears 603 since the interior of housing 672 or a portion of the interior of housing 672 tapers toward the end of pencil sharpener 600 away from central gear 601.

In typical use of the present embodiment, collapsible aperture 675 in round assembly 673 contracts when lever 671 on one side of round assembly 673 is depressed, and when the pressure is released from lever 671, a spring inside round assembly 673 causes collapsible aperture 675 to return to a default fully open position. Round assembly 673 moves back and forth on threaded shafts 607. In the present embodiment, collapsible aperture 675 comprises six blades 613 arranged around collapsible aperture 675 at an angle to increase the penetration of the material of pencil 621 by blades 613. However, alternate embodiments may comprise more or fewer blades on the collapsible aperture. When inserted into pencil sharpener 600 in the present embodiment, pencil 621 passes through opening 602 while activating the switch 604 and passing through metal strip loop 606 and through collapsible aperture 675. The start switch 604 energizes motor 631 that rotates drive gear 605 that in turn rotates central gear 601. Central gear 601 then rotates threaded shafts 607 through secondary gears 603, the rotation of which causes round assembly 673 to travel the length of threaded shafts 607. At the same time, the ridge on the inside of housing 672, which is angled toward the end of pencil sharpener 600 away from central gear 601, causes lever 671 to depress inwards. In an alternate embodiment, the housing of the pencil sharpener may not comprise a ridge, and instead the lever is depressed by the housing itself. In this embodiment the entire housing may be angled toward the end of the pencil sharpener. In the present embodiment, the depression of lever 671 by the ridge on housing 672 causes collapsible aperture 675 to constrict or close. At this time, the six blades 613 arranged around collapsible opening 675 in a circular fashion, penetrate the body of pencil 621 and start shaving material from pencil 621. This continues until lever 671 is depressed fully, which causes collapsible aperture 675 to become sufficiently small for blades 613 to leave the lead of pencil 621 in a fine pointed state. At the end of the cycle, lever 671 is released from the pressure of the ridge, which causes collapsible aperture 675 to fully open, and a limit switch 677, reverses motor 631 and round assembly 673 travels back to the original default position near central gear 601, ready to repeat the cycle. Some embodiments may comprise a second switch near the central gear to stop the motor once the round assembly reaches the starting position. In an alternate embodiment, the pressure of the ridge is not released from the lever once the round assembly reaches the end of the cycle. Instead, in this embodiment, the round assembly triggers a limit switch at the end of the cycle, which causes the motor to reverse to return the round assembly to the default position. As the round assembly travels back to the default position, the pressure on the lever is gradually released as the lever travels backward along the angled ridge, gradually opening the collapsible opening to the default open position.

Another embodiment as shown in FIG. 7A where there is an additional gear 609 that along with the two secondary gears 603 are all rotated by central gear 601. The third gear 609 has a stem 611 and at the end of the stem 611 there is another gear 677*a* that meshes with the gears 679 on an alternate round assembly 681. Gear 679 takes the place of lever 671 and the rotation of gear 679 causes the aperture opening to close and when the motor 631 reverses, gear 677*a* reverses, that causes gear 679 to rotate in reverse also.

Those skilled in the art, in light of the present teachings, will readily recognize that there is a multiplicity of alternative and suitable designs for the exterior housings of pencil sharpeners according to embodiments of the present invention. For example, without limitation some embodiments may be deigned to be hand held while other embodiments may be designed to sit on a desk or be mounted to a wall. Furthermore, various different features may be included in the exterior housing such as, but not limited to, removable compartments for emptying pencil shavings, multiple holes for pencils of different sizes, a transparent exterior or window to see when the pencil sharpener is full of shavings, etc. Also electric embodiments of the present invention may be battery powered or may plug into a wall outlet.

Having fully described at least one embodiment of the present invention, other equivalent or alternative methods of providing a pencil sharpener that is quiet and effective according to the present invention will be apparent to those skilled in the art. The invention has been described above by way of illustration, and the specific embodiments disclosed are not intended to limit the invention to the particular forms disclosed. For example, the particular implementation of the drive system may vary depending upon the particular type of power source used. The power sources described in the foregoing were directed to electric implementations; however, similar techniques are to provide drive systems that may be powered without electricity, for example, without limitation, by a hand crank. Non-electric implementations of the present invention are contemplated as within the scope of the present invention. The invention is thus to cover all modifications, equivalents, and alternatives falling within the spirit and scope of the following claims.

The invention claimed is:

1. A pencil sharpening assembly housed inside a pencil sharpener, the assembly comprising:

a central gear comprising an aperture along an axis of said central gear configured for receiving an end portion of a pencil;

a first gear configured for rotating said central gear;

a strap joined to said central gear and configured for securing the pencil wherein, when said central gear is rotated, said strap constricts about said aperture in a loop;

a shaft coupled to a second gear in mesh with said central gear and configured for rotation in a direction of rotation of said first gear wherein when said central gear is rotated said shaft is rotated; and a cutting blade coupled to said shaft configured to move in a direction along a length of said shaft when said shaft is rotated wherein when said shaft is rotated said cutting blade is operable to cut an opposite end portion of the pencil at an angle to form a point.

2. The pencil sharpening assembly as recited in claim 1, further comprising a motor for rotating said first gear in a first direction where the pencil is secured and said cutting blade cuts the pencil.

3. The pencil sharpening assembly as recited in claim 2, further comprising a start switch for detecting the pencil in said aperture and activating said motor to rotate in said first direction.

4. The pencil sharpening assembly as recited in claim 3, further comprising a plurality of drums placed between said first gear and said central gear, in communication with said central gear via a plurality of additional gears meshed with said central gear, and configured for rotation in a direction of rotation of said first gear for rotating the pencil while said cutting blade rotates in a direction towards said opposite end portion of the pencil when said first gear rotates in said first direction.

5. A pencil sharpening assembly housed inside a pencil sharpener, the assembly comprising:

a central gear comprising an aperture along an axis of said central gear configured for receiving an end portion of a pencil;

a first gear configured for rotating said central gear;

a motor for rotating said first gear in a first direction;

a strap joined to said central gear and configured for securing the pencil wherein, when said first gear is rotated in said first direction and said central gear is rotated, said strap constricts about said aperture in a loop;

a threaded shaft coupled to a second gear in mesh with said central gear and configured for rotation in a direction of rotation of said first gear wherein when said central gear is rotated said shaft is rotated;

a cutting blade coupled to said shaft to move in a direction along a length of said shaft wherein when said shaft is rotated in said first direction said cutting blade travels towards an opposite end portion of the pencil and is operable to cut said opposite end portion of the pencil at an angle to form a point; and a start switch for detecting the pencil in said aperture and activating said motor to rotate in said first direction.

6. The pencil sharpening assembly as recited in claim 5, further comprising a limit switch for activating said motor to rotate said first gear in a second direction to release the pencil from said strap.

7. The pencil sharpening assembly as recited in claim 5, further comprising a plurality of cutting blades each coupled to a plurality of shafts, said shafts each coupled to a plurality of second gears in mesh with said central gear and configured for rotation in a direction of rotation of said first gear wherein when said first gear is rotated in said first direction said plurality of shafts are rotated and said plurality of cutting blades travel along said plurality of shafts in a direction along the pencil and towards said opposite end portion of the pencil and said plurality of cutting blades cut said opposite end portion of the pencil at the angle to form the point.

8. The pencil sharpening assembly as recited in claim 7, wherein each of said plurality of cutting blades travels along separate ones of said plurality of shafts and said plurality of shafts are arranged at angles to form the point.

9. The pencil sharpening assembly as recited in claim 8, further comprising a housing in cooperation with said plurality of cutting blades to substantially prevent said plurality of cutting blades from rotating while traveling along said plurality of shafts.

10. A pencil sharpening assembly housed inside a pencil sharpener, the assembly comprising:

a central gear comprising an aperture along an axis of said central gear configured for receiving an end portion of a pencil;

a first gear configured for rotating said central gear;

a motor for rotating said first gear in a first direction;

a strap joined to said central gear and configured for securing the pencil wherein, when said first gear is rotated in said first direction and said central gear is rotated, said strap constricts about said aperture in a loop;

a plurality of threaded shafts each coupled to a second gear in mesh with and disposed along a perimeter of said central gear and configured for rotation in a direction of rotation of said first gear wherein when said central gear is rotated said plurality of shafts are rotated;

a plurality of cutting blades coupled to said plurality of shafts to move in a direction along a length of said shafts wherein when said shafts are rotated in said first direction said plurality of cutting blades travels towards an opposite end portion of the pencil and are operable to cut said opposite end portion of the pencil at an angle to form a point; and a start switch for detecting the pencil in said aperture and activating said motor to rotate in said first direction.

11. The pencil sharpening assembly as recited in claim 10, further comprises a round assembly comprising a collapsible aperture and said plurality of cutting blades are positioned about a periphery of said collapsible aperture.

12. The pencil sharpening assembly as recited in claim 11, further comprising a housing in cooperation with said round assembly to change a diameter of said collapsible aperture when said first gear is rotated.

13. The pencil sharpening assembly as recited in claim 11, wherein said round assembly further comprises a gear assembly in cooperation with said round assembly to change a diameter of said collapsible aperture when said first gear is rotated.

* * * * *